US005891830A

United States Patent [19]

Koltermann et al.

[11] Patent Number: 5,891,830

[45] Date of Patent: Apr. 6, 1999

[54] LUBRICATING GREASE

[75] Inventors: Terry J. Koltermann, The Woodlands, Tex.; Thomas F. Willey, Aliso Viejo, Calif.

[73] Assignee: Baker Hughes Incorporated, Houston, Tex.

[21] Appl. No.: 791,878

[22] Filed: Jan. 31, 1997

[51] Int. Cl.[6] ..... C10M 169/00

[52] U.S. Cl. ..... 308/136; 508/167; 508/144; 508/208; 508/539; 175/227

[58] Field of Search ..... 508/167, 208, 508/136, 144, 539; 175/227

[56] References Cited

U.S. PATENT DOCUMENTS

| | | | |
|---|---|---|---|
| 3,844,955 | 10/1974 | Green | 508/169 |
| 4,358,384 | 11/1982 | Newcomb | 252/19 |
| 4,409,112 | 10/1983 | Urmy, Jr. | 252/33.4 |
| 4,473,481 | 9/1984 | Fukatsuka et al. | 508/169 |
| 5,015,401 | 5/1991 | Landry et al. | 508/169 |
| 5,236,610 | 8/1993 | Perez et al. | 252/56 |
| 5,282,986 | 2/1994 | Otake et al. | 508/161 |
| 5,366,648 | 11/1994 | Saloman et al. | 252/42.7 |
| 5,380,469 | 1/1995 | Flider | 252/565 |
| 5,589,443 | 12/1996 | Denton | 508/169 |

FOREIGN PATENT DOCUMENTS

| | | | |
|---|---|---|---|
| 0 191 608 A2 | 2/1986 | European Pat. Off. | 169/6 |

OTHER PUBLICATIONS

C. J. Boner, "Modern Lubricating Greases", Scientific Publications (GB) LTD, Chapter 4, pp. 4.1–4.15.

*Primary Examiner*—Jaqueline V. Howard
*Attorney, Agent, or Firm*—Charles D. Gunter, Jr.

[57] ABSTRACT

A heavy-duty lubricating grease is shown which includes a synthetic fluid base and a thickener system. The heavy-duty grease can be used in both rolling element and journal type rock bit bearings to drill in heavy-duty, high temperature applications, such as in the bearing structures of rock bits used to drill hot subterranean formations.

26 Claims, 1 Drawing Sheet

11
17
13
29
15
31
23
45
43
27
37
25
33
19
21
41
39

LUBRICATING GREASE

BACKGROUND OF THE INVENTION

1. Field of the Invention

The present invention relates generally to grease compositions designed for use in heavy-duty, high temperature applications such as the lubricating compositions which are used to lubricate journal bearing and rolling element type rock bits used to drill hot subterranean formations.

2. Description of the Prior Art

There is a continuing need to develop functional fluids capable of serving as lubricant compositions in extreme temperature and pressure environments. Such an example environment is that of bits used to drill subterranean formations.

Rock bits of the rolling element and journal bearing types are employed for drilling such subterranean formations in order to produce oil, gas, geothermal steam and other fluids. Such bits have a body with a threaded upper extent which is connected within a drill string leading to the surface and have several, typically three, cutter cones which are mounted on pins integral with the body of the bit at its lower end.

In use, the drill string and bit body are rotated within the borehole and each cone is caused to rotate on its respective pin as the cone contacts the bottom of the borehole to disintegrate earthen formations. As the rock bit begins to penetrate hard, tough earthen formations, high pressures and temperatures are encountered. Typical drilling operations thus take place in an abrasive atmosphere of drilling mud and rock particles which are thousands of feet from the engineer or supervisor, who does not typically have the benefit of oil pressure gauges or temperature sensors at the surfaces to be lubricated.

Lubricants used in the bearing regions of such rock bits are thus a critical element of the life of the rock bit. The grease utilized to lubricate a rock bit of this type will often encounter temperatures above 300° F., thereby subjecting the lubrication system to severe and demanding constraints. The lubricant must not break down under the temperature and pressure conditions encountered, must not generate substantial internal pressures in the bit, must enable flow through passages to the surfaces to be lubricated and must prevent solid lubricant particles from settling out.

Failure of the lubrication system quickly results in failure of the rock bit as a whole. When the rock bit wears out or fails as the borehole is being drilled, it is necessary to withdraw the drill string for replacing the bit. The amount of time required to make a round trip for replacing a bit is essentially lost from drilling operations. This time can become a significant portion of the total time for completing a well, particularly as the well depths become greater and greater. A successful grease should have a useful life longer than other elements of the rock bit so that premature failures of bearings do not unduly limit drilling.

A variety of grease compositions have been employed in rock bits in the past. Such grease compositions typically comprise a high viscosity, refined petroleum (hydrocarbon) oil or mineral oil which provides the basic lubricity of the composition and may constitute about ¾ of the total grease composition. The refined hydrocarbon or mineral oil is typically thickened with a metal soap or metal complex soap, the metals being typically selected from aluminum, barium, calcium, lithium, sodium or strontium. Complex, thickened greases are well known in the art and are discussed, for example, in *Encyclopedia of Chemical Technology*, Kirk-Othmer, Second Edition, A. Standen, Editor, Interscience Publishers, John Wiley and Sons, Inc., New York, N.Y., 1967, pages 582–587. See also *Modern Lubricating Greases*, by C. J. Boner, Scientific Publications (GB) Limited, Chapter 4.

The prior art shows solid extreme pressure (EP) additives which have been employed to attempt to enhance the lubrication properties of oils and greases. For example, molybdenum disulfide has been used in a wide variety of lubricants as discussed in U.S. Pat. Nos. 3,062,741; 3,170,878; 3,281,355; and 3,384,582. Other solid additives which are widely used include copper, lead and graphite.

It is also known to include metallic oxides like zinc oxide in lubrication oils. U.S. Pat. No. 2,736,700 describes the use of molybdenum disulfide and a metallic oxide such as fumed lead oxide and zinc oxide in a paint-on composition or bonded lubricant. Such bonded lubricants are used for drawing tough metals such as uranium, thorium, zinc and titanium. Such bonded lubricants are inadequate and could not be used in the extreme wear, heavily loaded applications for which this invention is intended.

U.S. Pat. No. 3,935,114, assigned to the assignee of the present invention, teaches the use of molybdenum disulfide and antimony trioxide in a lubricating grease for a journal bearing used in a drill bit. This grease has proved particularly effective when used in copper inlay-on-boronized bearings of rock bits.

U.S. Pat. No. 5,015,401, issued May 14, 1991, and assigned to the assignee of the present invention shows a rock bit bearing grease which includes a refined petroleum or hydrocarbon oil fluid base which is thickened with an alkaline metal soap or metal soap complex and which contains as solid lubricants powdered molybdenum disulfide and calcium fluoride. This grease was especially useful in carb-on-carb bearings, providing extended wear life and load carrying capacity.

Despite these advances, the lubricating greases for rock bits of the prior art have all tended to use as the base or carrier fluid a refined hydrocarbon or mineral oil thickened with some type of thermally stable gelling agents, perhaps with solid lubricants or other oil soluble property enhancing additives being included, as well. Manufacturers of lubricating greases for rock bit bearings have not, to Applicants'knowledge, employed grease formulations with the base or carrier material being a substantial portion of a synthetic fluid or fluids. By "synthetic fluids", is meant, for example, synthetic hydrocarbon fluids or oils, polyol esters, dimer acids, synthetic polyethers and synthetic fluorinated polyethers, alkylene oxide polymers or interpolymers, esters of phosphorus containing acids, silicon based oils, or a mixture of the above type "synthetic" fluids. Commercially available base fluids of this type, such as Mobil Oil's "SHF-82", Emery Industries' "Emery 3000" and Amoco's "Polybutene Series", while utilized in, for example, the aircraft and automotive industries, have not been utilized in lubricating greases for rock bit bearings, to Applicants'knowledge.

The present invention is directed toward the discovery that a grease composition suitable for use in rock bit bearings can be formulated with a synthetic fluid base and thickened with specific thickener systems to produce a grease which is particularly effective for the slow speed and highly loaded bearing configurations of rolling element and journal type rock bit bearings used to drill earthen formations.

The preferred thickener systems of the present invention impart not only gel structure to the grease but also extreme pressure and antiwear properties. The thickener systems of this invention include calcium complex soap thickeners in which calcium hydroxide and acetic acid are two of the reactants forming the thickener as well as other metal soap thickeners and their complexes in combination with calcium acetate which is either added or formed in the synthetic fluid base. The thickener systems of this invention also include non-soap thickeners such as silica gellants or clays in combination with calcium acetate which is either added or formed in the synthetic fluid base.

A need exists, therefore, for such a bearing grease with superior lubricating properties which can be employed in lubricating the bearing surfaces of bits used for drilling in abrasive, subterranean atmospheres.

A need also exists for such a bearing grease exhibiting low wear characteristics which can be used in rock bit bearings to provide extended wear life and load carrying capacity.

A need also exists for such a grease for lubricating rock bits which has a prolonged useful life, which does not generate substantial internal pressures within the bit and which adequately protects metal bearing surfaces from premature wear or failure.

SUMMARY OF THE INVENTION

Accordingly, it is an object of this invention to provide a lubricating grease having a synthetic fluid base that is temperature stable and which can be employed under severe and demanding conditions, such as, for example, lubricating the bearing structures of rock bits used to penetrate subterranean formations.

Another object of the invention is to provide a grease of the above type which has physical properties sufficient to provide lubrication and protection adequate at operating temperatures in excess of 300° F.

These and other objects of the invention are exemplified by a novel rock bit bearing grease formulation which comprises:

(a) a synthetic fluid base;

(b) a specific thickener system for the synthetic fluid base which, when added to the base, forms a lubricating grease with improved properties; and (c) wherein the resulting lubricating grease is stable at downhole temperatures and pressures so as to be useful in bits drilling in hot subterranean formations.

The preferred synthetic fluid base is preferably selected from the group consisting of synthetic hydrocarbon fluids, polyol esters, synthetic polyethers, alkylene oxide polymers and interpolymers, esters of phosphorous containing acids, silicon based oils and mixtures of the above. A particularly preferred synthetic fluid base is a hydrogenated polyalphaolefin synthetic hydrocarbon oil or a mixture of such oil with a polyol ester fluid.

The thickener systems of this invention include calcium complex soap thickeners in which calcium hydroxide and acetic acid are two of the reactants forming the thickener as well as other metal soap thickeners, their complexes and mixtures thereof in combination with calcium acetate which is either added or formed in the synthetic fluid base. The thickener systems of this invention also include non-soap thickeners such as silica gellants or clays and mixtures thereof combined with calcium acetate which is either added or formed in the synthetic fluid base. Additionally, the metal soap and non-soap thickeners may be mixed.

A preferred metal complex soap thickener is a fatty acid complex formed by the reaction of calcium hydroxide with several organic acids of which one is acetic acid and the others of which are higher molecular weight organic acids. Other thickener systems of this invention include metal soap thickeners and their complexes in combination with calcium acetate which is either added or formed in the synthetic fluid base wherein the metal is selected from the group consisting of aluminum, barium, calcium, lithium, sodium, and strontium.

Other thickener systems of this invention are inorganic thickeners such as silica gellant thickeners, modified clay thickeners, dye and pigment thickeners and other inert type thickeners such as carbon black, graphite, polytetrafluoroethylene (PTFE) in combination with calcium acetate which is either added to or formed in the synthetic fluid base. Preferred thickeners of this type consist of silica gellant and calcium acetate as well as modified clay and calcium acetate where the calcium acetate is formed in the synthetic fluid base by reaction of calcium hydroxide and acetic acid.

Traditional solid lubricant packages and other oil soluble performance enhancing additives can also be included in the formulations of the invention.

The novel lubricating grease of the invention can be used to manufacture an earth boring drill bit of the type having a bearing pin extending from a head section of a drill bit for rotatably mounting a cutter thereon, where the bearing pin has an external region which contacts an internal region of the cutter after assembly. The region of contact between the external region of the bearing pin and the internal region of the cutter is lubricated with the heavy-duty lubricating grease of the invention, preferably after the external region of the bearing pin and internal region of the cutter have been carburized or otherwise heat treated. The lubricating grease preferably comprises:

(a) a synthetic hydrocarbon fluid or combination of a synthetic hydrocarbon and synthetic polyol ester fluids as the fluid base;

(b) a thickener system which imparts not only gel structure to the grease but also extreme pressure and antiwear properties; preferred thickener systems including (1) calcium complex soap thickeners in which calcium hydroxide and acetic acid are two of the reactants forming the thickener as well as other metal soap thickeners and their complexes in combination with calcium acetate which is either added or formed in the synthetic fluid base; and (2) non-soap thickeners such as silica gellants or clays in combination with calcium acetate which is either added or formed in the synthetic fluid base; and (c) wherein the resulting lubricating grease is stable at temperatures up to at least 300° F. and at accompanying downhole pressures so as to be useful in bits drilling in hot subterranean formations.

Additional objects, features and advantages will be apparent in the written description which follows.

DETAILED DESCRIPTION OF THE INVENTION

Figure 1:
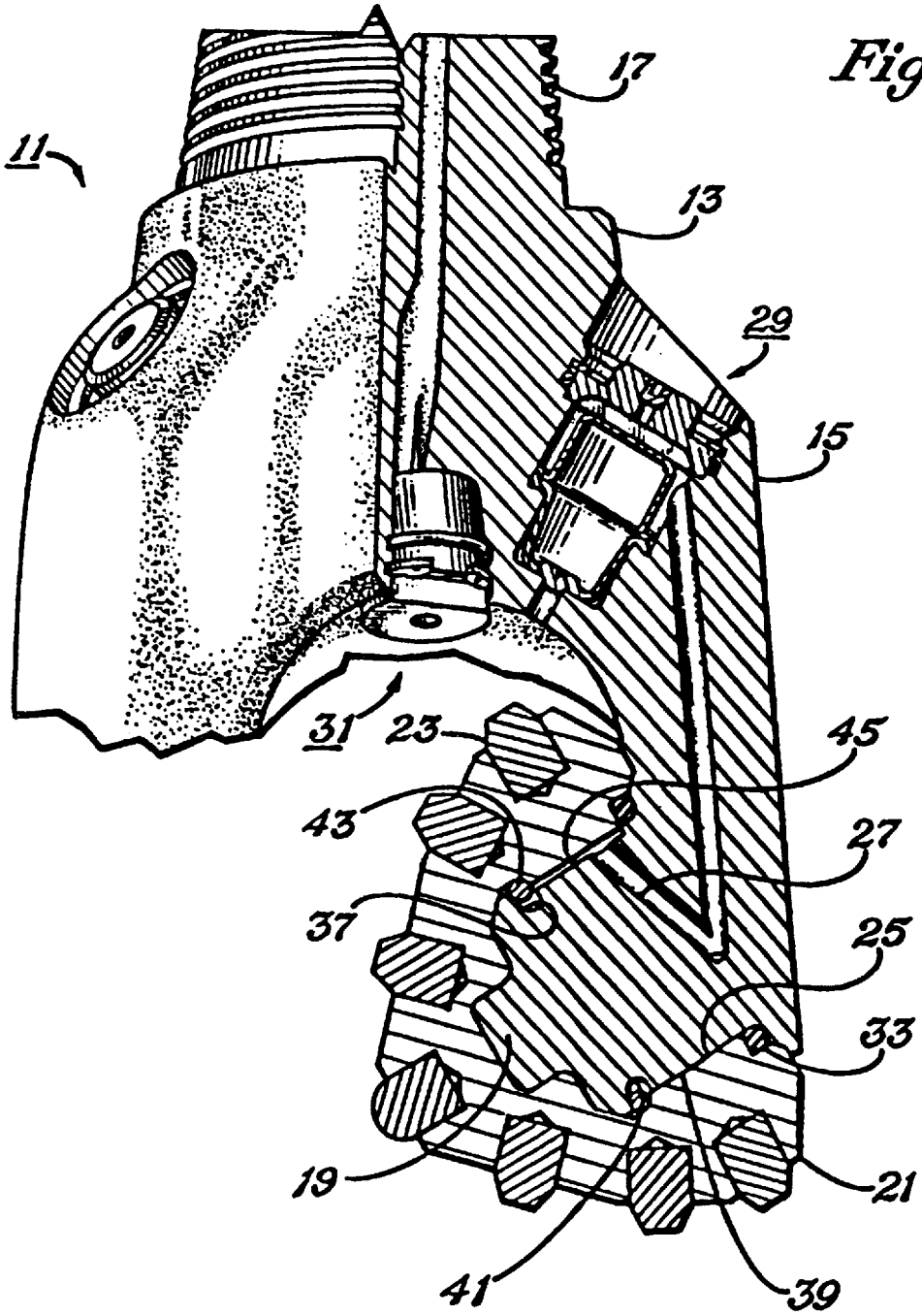
FIG. 1 is a side, perspective view of an earth boring drill bit which receives the lubricating grease of the invention, partly in section and partly broken away.

The grease of the invention is formulated from a novel synthetic fluid base which is thickened with a companion thickener system and which can contain traditional solid lubricants as well as other traditional oil soluble performance enhancing additives.

To be suitable for use in the slow speed, heavily loaded work environment of a rock bit bearing, the grease of the invention must meet certain established criteria and must provide lubrication and protection adequate for operating temperatures up to 300° F. and above.

The lubricating grease of the invention preferably has a worked penetration as measured in an ASTM D-217 test, in depths of penetration in tenths of a millimeter in 5 seconds at 77° F., of no less than 265. The lubricating grease of the invention has a National Lubricating Grease Institute (NLGI) classification of less than Class 3 to effect the requisite flow through passageways to reach and to lubricate the surfaces of interfacing elements, such as bearings. Thus, the lubricating grease of the invention falls into the NLGI Class 00, Class 0, Class 1 or Class 2. The NLGI table of classification, including physical properties for the classes, is included in the above-referenced *Encyclopedia of Chemical Technology.*

The rock bit bearing grease of the invention utilizes a novel synthetic fluid base as opposed to the prior art of refined petroleum or mineral oil fluid bases used as the "carrier" for the grease. The synthetic base stocks utilized in the preparation of the lubricating greases of the invention can be any of the known synthetic oils or fluids previously used as base stocks in high temperature applications provided that they exhibit good high temperature characteristics which are liquid and maintain their lubricating properties at temperatures and pressure conditions encountered in drilling subterranean formations. The preferred synthetic fluid base is selected from the group consisting of synthetic hydrocarbon fluids and oils, polyol esters, synthetic polyethers, alkylene oxide polymers and interpolymers, esters of phosphorous containing acids, silicon based oils and mixtures of the above.

One preferred class of synthetic fluid bases is that of synthetic polyolefins, particularly hydrogenated polyalphaolefins, although other synthetic polyolefins may be utilized as well. Examples of the synthetic hydrocarbon oils which may be utilized as the synthetic fluid bases for the greases of the invention are saturated and are thus prepared by polymerizing unsaturated monomers (e.g., ethylene) and are hydrogenated prior to use to remove any unsaturation from the synthetic oil. Examples of the saturated hydrocarbon oils, which include halo-substituted hydrocarbon oils, are the hydrogenated polymerized and interpolymerized olefins such as fluid polyethylenes, polypropylenes, polybutylenes, propylene-isobutylene copolymers, chlorinated polybutylenes, poly(1-hexenes), poly(1-octenes), poly (1-decenes); polymers of alkyl benzenes, such as dodecylbenzenes, tetradecylbenzenes, dinonylbenzenes, di-(2-ethyl-hexyl)-benzenes, etc.; polyphenyls such as biphenyls, terphenyls, alkylated polyphenyls, etc.; alkylated diphenyl ethers and alkylated diphenyl sulfides and the derivatives, analogs and homologs thereof. Also included are deuterated synthetic hydrocarbon oils. The hydrogenated polyolefins derived from $\alpha$ aliphatic olefins such as ethylene, propylene, 1-butene, etc. are preferred examples of polyolefins useful as the synthetic fluid base. Fluid hydrogenated polyolefins useful as synthetic fluid bases are commercially available from a number of sources including Amoco's Polybutene Series, Mobil Oil's SHF Series and Emery Industries Emery 3000 Series.

The preferred synthetic fluid base polyol polyesters are obtained by reacting various polyhydroxy compounds with carboxylic acids. When the carboxylic acids are dicarboxylic acids, mono-hydroxy compounds can be substituted for the polyols. For example, useful synthetic esters include the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc. with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-N-hexyl fumarate, dioctyl sebacate, diisooctyl azelate, diisodecyl azelate, dioctyl phthalate, didecyl phthalate, etc.

Particularly preferred synthetic ester oils are the esters of trimethylol propane, trimethylol butane, trimethylol ethane, pentaerythritol and/or dipentaerythritol with one or more monocarboxylic acids containing from about 5 to 10 carbon atoms. Commercially available fluids of this type include "HERCOLUBE" A, B, C, F and J available from Hercules Incorporated.

Examples of esters of phosphorous containing acids which are useful as the synthetic fluid bases in the greases of the invention include triphenyl phosphate, tricresyl phosphate, trixylyl phosphate, trioctyl phosphate, diethyl ester of decane phosphonic acid, etc.

Silicon-based oils such as the polyalkyl-, polyaryl-, polyalkoxy-, and polyaryloxy-siloxane oils and silicate oils comprise another useful class of synthetic base fluids and will be familiar to those skilled in the art. Examples of the silicate oils include tetraethyl silicate, tetraisopropyl silicate, tetra-(2-ethylhexyl) silicate, tetra-(4-methyl-hexyl) silicate andtetra-(p-t-butyl-phenyl) silicate. In one preferred embodiment, the silicon-based oils are polysilicones such as alkyl phenyl silicones or siloxanes. The alkyl phenyl silicones can be prepared by the hydrolysis and condensation reactions as described in the art such as, for example, in *An Introduction to the Chemistry of the Silicones*, by Eugene G. Rochow, John Wiley & Sons, Inc., New York, Second Edition (1951). The silicone-containing fluids may be polysiloxanes having units of the general formula $$R_nSiO_{4-n}/2$$

wherein n has a value from about 1.1 to about 2.9 and R represents the same or different organyl groups. Some examples of such organyl groups are: hydrocarbons including aliphatic groups, e.g., methyl, propyl, pentyl, hexyl, decyl, etc., alicyclic groups, e.g., cyclohexyl, cyclopentyl, etc., aryl groups, e.g., phenyl, naphthyl, etc., aralkyl groups, e.g., benzyl, etc., and alkaryl groups, e.g., tolyl, xylyl, etc.; the halogenated, oxygen-containing, and nitrogen-containing organyl groups including halogenated aryl groups, alkyl and aryl ether groups, aliphatic ester groups, organic acid groups, cyanoalkyl groups, etc. The organyl groups, in general, contain from 1 to about 30 carbon atoms.

Of particular interest are polysiloxane fluids containing organo-siloxane units of the above formula wherein R is selected from the group of (a) alkyl groups, e.g., methyl, (b) mixed alkyl and aryl, e.g., phenyl groups, in a mole ratio of alkyl to aryl from about 0.5 to about 25, (c) mixed alkyl and halogenated aryl groups, e.g., chlorinated, brominated phenyl, in a mole ratio of alkyl to halogenated aryl of from 0.5 to about 25 and mixed alkyl, aryl and halogenated aryl groups in a mole ratio of alkyl to total aryl and halogenated aryl from about 0.5 to about 25. The halogenated aryl groups in all cases contain from 1–5 halogen atoms each. These silicone fluids may, of course, also be physical mixtures of one or more of the polysiloxanes in which R is as defined above.

The viscosity of the silicone fluids will vary depending upon the starting materials, their method of preparation etc. In general, the fluids may possess molecular weights of from about 200 to about 10,000.

In one embodiment, the alkyl phenyl silicon base oils useful in the present invention may be represented as containing repeating units represented by the general formula

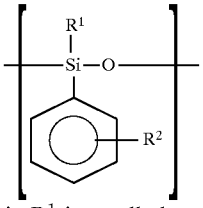

(II)

wherein $R^1$ is an alkyl group containing from 1 to about 6 carbon atoms and $R^2$ is a hydrogen atom, halogen, or an alkyl group containing from 1 to 3 carbon atoms.

Specific examples of the alkyl phenyl polysiloxanes of the type containing the repeating structure (II) include methyl phenyl silicone, methyl tolyl silicone, methyl ethylphenyl silicone, ethyl phenyl silicone, propyl phenyl silicone, butyl phenyl silicone and hexyl propylphenyl silicone.

The alkyl phenyl silicones of the type described above generally are characterized as having molecular weights within the range of about 500 to 4000. Generally, however, the size of the molecule is not expressed with reference to the molecular weight, but, rather, by reference to a viscosity range. For example, the alkyl phenyl silicones useful in the present invention may have kinematic viscosities ranging from about 20 to about 2000 centistokes at 25° C., and preferably from about 150 to about 1000 centistokes at 25° C.

Alkyl phenyl silicones of the type useful in the present invention are commercially available from Dow Corning Corporation, the General Electric Company and others. Specific examples of methyl phenyl silicones which may be employed in the present invention include SF-1153 from General Electric Company having a viscosity at 25° C. of 100 centistokes. Another synthetic silicone is a methyl phenyl polysiloxane sold by General Electric Company under the trade name SF-1038. The viscosity of this material at 25° C. ranges from about 150 to about 1000 centistokes.

Synthetic polyethers are also useful as the synthetic base oil in the functional fluids of the present invention. In one embodiment, the polyethers may be polyphenyl ether fluids which have a wide liquid range and remain in the liquid phase at temperatures of from below −100° F. up to 800° F. or higher. The polyphenyl ethers may contain from 3 to 7 benzene rings and from 2 to 6 oxygen atoms, and the oxygen atoms join the benzene rings in chains as ether linkages. One or more of the benzene rings may be hydrocarbyl-substituted. The hydrocarbyl substituents, for thermal stability, must be free of $CH_2$ and aliphatic CH groups so that the preferred aliphatic substituents are lower saturated hydrocarbon groups (1 to 6 carbon atoms) such as ethyl and t-butyl. Preferred aromatic substituents are aryl groups such as phenyl, tolyl, t-butyl phenyl and alphacumyl. Polyphenyl ethers consisting exclusively of chains of from 3 to 7 benzene rings with at least two oxygen atom joining the benzene rings in the chains as an ether linkage have particularly desirable thermal stability. Examples of the polyphenyl ethers such as 1-(p-methylphenoxy)-4-phenoxy benzene and 2,4-diphenoxy-1-methyl benzene; 4-ring polyphenyl ethers such as bis[p-(p-methylphenoxy) phenyl] ether and bis [p-(p-t-butylphenoxy) phenyl] ether, etc.

The above-described polyphenyl ethers can be obtained by known procedures such as, for example, the Ullmann ether synthesis which broadly relates to ether-forming reactions wherein alkali metal phenoxides such as sodium and potassium phenoxide are reacted with aromatic halides such as bromobenzene in the presence of a copper catalyst such as metallic copper, copper hydroxide or copper salts. An example of a commercially available polyether is a polyphenyl ether available from Monsanto under the designation "OS-124."

Alkylene oxide polymers and interpolymers and derivatives thereof wherein the terminal hydroxyl groups have been modified by esterification, etherification, etc., constitute another class of synthetic lubricating oils that can be utilized as the base oil in the functional fluids. These fluids may be exemplified by the oils prepared through polymerization of ethylene oxide or propylene oxide, the alkyl and aryl ethers of these polyoxyalkylene polymers such as methyl polyisopropylene glycol ether having an average molecular weight of about 1000, diphenyl ether of polyethylene glycol having a molecular weight of about 500 to 1000, diethyl ether of polypropylene glycol having a molecular weight of about 1000 to about 1500.

The amount of synthetic fluid base included in the high temperature functional greases of the present invention is a major amount. By major amount is meant an amount on the order of greater than 50% by weight of the total weight of the grease. The greases of the present invention preferably, are essentially free of natural oils which are not stable at the higher temperatures. In some embodiments some natural oils such as mineral oils can be tolerated, but the greases of the present invention should contain less than 5% by weight of the natural oils, and more preferably less than 1%.

The greases of the present invention may be prepared from mixtures of two or more of the above-described synthetic fluid bases. For example, the synthetic fluid base used may comprise from about 10 to 98 parts of one fluid base such as the polyalphaolefin oil and 2 to 90 parts of a second fluid base such as the polyol ester fluid. Other useful weight ratios may be from 20:80 to 50:50.

The rock bit bearing grease of this invention also includes specific thickener systems for the synthetic fluid base which impart not only gel structure to the grease but also extreme pressure and antiwear properties. The preferred metal complex soap thickener is a calcium complex in which the fatty acid complex formed by the reaction of calcium hydroxide with several organic acids of which one is acetic acid and the others of which are higher molecular weight organic acids. The higher molecular weight acids are preferably a combination of monobasic carboxylic acids of 18, 8 and 10 carbons. Other thickener systems of this invention include metal soap thickeners and their complexes in combination with calcium acetate which is either added or formed in the synthetic fluid base wherein the metal is selected from the group consisting of aluminum, barium, calcium, lithium, sodium, and strontium.

A second preferred thickener system of this invention consists of silica gellant and calcium acetate where the calcium acetate is formed in the synthetic fluid base by reaction of calcium hydroxide and acetic acid.

A third preferred thickener system of this invention consists of modified clay and calcium acetate where the calcium acetate is formed in the synthetic fluid base by reaction of calcium hydroxide and acetic acid.

Other thickener systems of this invention are dye and pigment thickeners, thickeners such as carbon black, graphite, polytetrafluoroethylene (PTFE) in combination with calcium acetate which is either added or formed in the synthetic fluid base.

Preferred thickener systems which have been used in experimental tests with the synthetic fluid base of the invention include: (1) calcium complex soap thickeners in which the fatty acid complex formed by the reaction of calcium hydroxide with several organic acids of which one is acetic acid and the others of which are higher molecular weight organic acids; (2) silica gellant and calcium acetate where the calcium acetate is formed in the synthetic fluid base by reaction of calcium hydroxide and acetic acid; and (3) modified clay and calcium acetate where the calcium acetate is formed in the synthetic fluid base by reaction of calcium hydroxide and acetic acid.

PREFERRED EMBODIMENT #1

The preferred embodiment is a base grease comprised of a small amount of a synthetic polyol ester fluid mixed with synthetic polyalphaolefin fluids which are thickened by a calcium complex soap formed by the reaction of calcium hydroxide with several organic acids. To this grease are added oil soluble antioxidants, corrosion inhibitors and metal deactivators as well as solid lubricants.

TABLE I

Typical formulation ranges for preferred embodiment base grease #1:*

| Item | Ingredient | Formulation range Weight Percent | Weight Percent |
|---|---|---|---|
| 1. | A polyalphaolefin fluid having a viscosity of 40 cst at 100° C. | 50.82 | 26.17 |
| 2. | A polyalphaolefin fluid having a viscosity of 100 cst at 100° C. | 33.88 | 17.44 |
| 3. | Calcium hydroxide high purity | 3.81 | 17.66 |
| 4. | A monobasic carboxylic acid of 18 carbons | 1.77 | 8.18 |
| 5. | A monobasic carboxylic acid of 8 carbons | 0.23 | 0.10 |
| 6. | A monobasic carboxylic acid of 10 carbons | 0.17 | 0.08 |
| 7. | Triglyceride of 12 hydroxystearic acid | 0.08 | 0.36 |
| 8. | Acetic acid | 5.65 | 26.18 |
| 9. | Trimethylol propane ester | 3.95 | 3.84 |

(1) A polyalphaolefin fluid having a viscosity of 40 cst at 100° C. - Durasyn 174, Amoco Chemical Corp.
(2) A polyalphaolefin fluid having a viscosity of 100 cst at 100° C. - Durasyn 180, Amoco Chemical Corp.
(9) Trimethylol propane ester (Polyol ester) - Uniflex 211, Union Camp Corp.
*A synthetic calcium complex GREASE - "GEOPLEX #2", Tom Lin Scientific, Inc. STANTON, CA 90680

Procedure to Prepare Preferred Embodiment #1

The calcium complex soap thickener is formed in the polyalphaolefin fluids (Items 1 and 2) by reacting the calcium hydroxide (Item 3) with the organic acids (Items 4, 5, 6, 7, and 8). To accomplish this, a grease saponification reaction vessel is charged with 100% of the 100 cst polyalphaolefin fluid (Item 2) and 70% of the total amount of the 40 cst polyalphaolefin fluid (Item 1). While mixing, the total amount of calcium hydroxide is added (Item 3) to the reaction vessel. Mixing is continued until the calcium hydroxide is completely dispersed in the oil. The fatty acids (Items 4, 5, 6, and 7) are slowly added with mixing. After all the fatty acids are added, the composition is mixed for a minimum of 10 minutes. The acetic acid is slowly added during the mixing (Item 8). After adding all the acetic acid, the composition is mixed for a minimum of 10 minutes. The composition is heated while mixing until the grease temperature reaches 250° F. With continued mixing, 18% of the total amount of the 40 cst polyalphaolefin fluid (Item 1) is added. Mixing is continued with heating until the grease temperature reaches 340° F., with the grease temperature being held at 340° F. for 20 minutes. While continuing to mix, heating is discontinued, allowing the composition to cool to below 220° F. The remaining 40 cst polyalphaolefin fluid (Item 1) is added with continued mixing. The trimethylol propane ester (Item 9) is then added with continued mixing until the grease reaches 150° F. At this point the grease is ready to mill.

PREFERRED EMBODIMENT #2

The second preferred embodiment is a base grease comprised of a small amount of a synthetic polyol ester fluid mixed with synthetic polyalphaolefin fluids containing calcium acetate formed by the reaction of calcium hydroxide with acetic acid and thickened by the addition of fumed silica. To this grease are added oil soluble antioxidants, corrosion inhibitors and metal deactivators as well as solid lubricants.

TABLE II

Typical formulation ranges for preferred embodiment base grease #2:*

| Item | Ingredient | Formulation range Weight Percent | Weight Percent |
|---|---|---|---|
| 1. | A polyalphaolefin fluid having a viscosity of 100 cst at 100° C. | 59.09 | 37.67 |
| 2. | A polyalphaolefin fluid having a viscosity of 40 cst at 100° C. | 15.76 | 10.05 |
| 3. | Calcium hydroxide high purity | 6.03 | 17.07 |
| 4. | Acetic acid | 9.78 | 27.67 |
| 5. | Fumed silica | 5.32 | 3.77 |
| 6. | Trimethylol (polyol) propane ester | 4.02 | 3.77 |

(1) A polyalphaolefin fluid having a viscosity of 100 cst at 100° C. - Durasyn 180, Amoco Chemical Corp.
(2) A polyalphaolefin fluid having a viscosity of 40 cst at 100° C. - Durasyn 174, Amoco Chemical Corp.
(6) Trimethylol propane ester (Polyol ester) - Uniflex 211, Union Camp Corp.
*PYRO-GEL #2 Tom Lin Scientific, STATION, CA 90680

Procedure to Prepare Preferred Embodiment #2

The second thickener is formed in the synthetic fluids by first reacting calcium hydroxide (Item 3) with acetic acid (Item 4) followed by addition of fumed silica (Item 5). To accomplish this a grease saponification vessel is charged with the 100 cst polyalphaolefin fluid (Item #1) and the 40 cst polyalphaolefin fluid (Item #2). While mixing, the total amount of calcium hydroxide (Item 3) is added to the reaction vessel. Mixing is continued until the calcium hydroxide is completely dispersed in the oil. While mixing slowly, the acetic acid (Item 4) is then added. After all the acetic acid is added the composition is mixed for a minimum of 10 minutes. The composition is heated while mixing until the grease temperature reaches 340° F. and the grease is held at 340° F. for 20 minutes. While continuing to mix, heating is discontinued and the composition is allowed to cool to below 180° F. The fumed silica (Item #5) is added and the composition is mixed slowly until all the silica is wetted.

The trimethylol propane ester (Item 6) is then added and mixing is continued until the grease is homogeneous. At this point the grease is ready to mill.

A variety of conventional solid additives can be utilized with the grease formulations of the invention. Such traditional additives include copper, lead, molybdenum disulfide, graphite, and the like. The grease compositions can also include conventional fillers, thickeners, thixotropic agents, extreme pressure additives, antioxidants, corrosion prevention materials, and the like. A preferred solid lubricant package is described in the previously referenced U.S. Pat. No. 3,935,114 which includes both molybdenum disulfide and antimony trioxide as solid lubricants. The solid lubricant components can be added at almost any stage in the manufacture of the final product. For example, they can be incorporated when the thickener is added if the thickener is not a metal soap type which is formed by a chemical reaction in the oil; or, they can be incorporated at some stage in the handling of the semi-finished product. It is only important that sufficient mixing be employed, as by working, homogenizing, or otherwise, to secure a complete, uniform and thorough dispersion of the solid particles throughout the grease formulation. Preferably, the solid lubricant package is added at any stage after the thickener is formed or added.

A laboratory test employing a bearing configuration similar to that found in an actual rock bit was used to evaluate the lubricating greases of the invention. Test parts were manufactured using the same materials and processing as are used to produce bearings for actual rock bits. The journal shaft in the laboratory bearing test is held stationary and a bushing is rotated to produce sliding speeds similar to those experienced by actual rock bit bearings. More specifically, the load bearing surface of the journal bearing shaft is comprised of a cobalt base alloy from a family of alloys commonly used for high performance bearings. The load bearing surface of the bushing is comprised of an alloy steel which has been carburized and hardened and overlaid with a thin layer of elemental silver. An elastomeric O-ring seal is captured between the rotating bushing and the stationary shaft to retain the grease in the bearing. The rotational speed is held constant and the load applied to the bearing is incremented by a fixed amount at regular intervals. The power in kilowatts required by the electric motor to rotate the bushing and the load in pounds applied to the bearing are measured throughout the test.

The power in kilowatts required to rotate the bushing at an applied load minus the power in kilowatts required to rotate the bushing with no load applied is termed the "bearing power requirement." The "bearing power requirement" is directly related to the friction in the bearing and is used as a comparative measure of lubricant performance in the tests which were performed. In Tables III and IV which follow, the lowest applied load at which the "bearing power requirement" either equals or exceeds one kilowatt for the grease samples evaluated in the laboratory bearing tests is reported.

TABLE III

| Test No. | Base Oil/ Synthetic Fluid | Thickener | Solid Lubricants (2) | Avg. Load In lbs. For A "Bearing Power Requirement" Of ≧ 1 KW" |
|---|---|---|---|---|
| 1. | mineral oil | calcium complex (1) | 14.2% $MoS_2$ 7.0% $Sb_2O_3$ | 23,000 |
| 2. | synthetic hydrocarbon/ polyol ester (3) | calcium complex (1) | 8.4% $MoS_2$ 2.2% $Sb_2O_3$ | 33,000 |
| 3. | synthetic hydrocarbon/ polyol ester (3) | calcium complex (1) | 14.2% $MoS_2$ 7.0% $Sb_2O_3$ | 33,000 |
| 4. | mineral oil | calcium complex (1) | 14.2% $MoS_2$ 7.0% $Sb_2O_3$ | 28,000 |
| 5. | synthetic hydrocarbon/ polyol ester (3) | calcium complex (1) | 14.2% $MoS_2$ 7.0% $Sb_2O_3$ | 32,000 |
| 6. | mineral oil | calcium complex (1) | 14.2% $MoS_2$ 7.0% $Sb_2O_3$ | 21,000 |
| 8. | synthetic hydrocarbon/ polyol ester (3) | calcium complex (1) | 14.2% $MoS_2$ 7.0% $Sb_2O_3$ | 36,000 |
| 9. | synthetic hydrocarbon/ polyol ester (3) | calcium complex (1) | 14.2% $MoS_2$ 7.0% $Sb_2O_3$ 0.6% graphite | 35,000 |
| 10. | mineral oil | calcium complex (1) | 14.2% $MoS_2$ 7.0% $Sb_2O_3$ | 22,000 |

(1) Calcium complex - The calcium complex thickener is formed in the mineral oil or synthetic fluid by reacting calcium hydroxide with acetic acid and monobasic carboxylic acids of 18 carbons as well as monobasic carboxylic acids of 8 carbons and 10 carbons and/or the triglyceride of 12 hydroxystearic acid.
(2) $MoS_2$ - molybdenum disulfide
$Sb_2O_3$ - antimony trioxide
(3) The synthetic hydrocarbon and polyol ester base fluids are those shown in Table I.

TABLE IV

| Test No. | Base Oil/ Synthetic Fluid | Thickener | Solid Lubricants (2) | Avg. Load In lbs. For A "Bearing Power Requirement" Of ≧ 1 KW" |
|---|---|---|---|---|
| 1. | mineral oil | calcium complex (1) | 14.2% $MoS_2$ 7.0% $Sb_2O_3$ | 23,000 |
| 4. | mineral oil | calcium complex (1) | 14.2% $MoS_2$ 7.0% $Sb_2O_3$ | 28,000 |
| 6. | mineral oil | calcium complex (1) | 14.2% $MoS_2$ 7.0% $Sb_2O_3$ | 21,000 |
| 7. | synthetic hydrocarbon (5) | fumed silica/ calcium acetate (3) | 15.0% $MoS_2$ 7.5% $Sb_2O_3$ | 37,000 |
| 10. | mineral oil | calcium complex (1) | 14.2% $MoS_2$ 7.0% $Sb_2O_3$ | 22,000 |
| 14. | synthetic hydrocarbon/ polyol ester (5) | organo-phillic clay/ calcium acetate (4) | 15.0% $MoS_2$ 7.5% $Sb_2O_3$ | 30,000 |
| 15. | synthetic hydrocarbon/ polyol ester (5) | fumed silica/ calcium acetate (3) | 15.0% $MoS_2$ 7.5% $Sb_2O_3$ | 28,000 |

(1) Calcium complex - The calcium complex thickener is formed in the mineral oil by reacting calcium hydroxide with acetic acid and monobasic carboxylic acids of 18 carbons as well as monobasic carboxylic acids of 8 carbons and 10 carbons.
(2) $MoS_2$ - molybdenum disulfide
$Sb_2O_3$ - antimony trioxide
(3) Fumed silica/calcium acetate - In the synthetic oil the calcium acetate is formed by reacting calcium hydroxide with acetic acid and then further thickening is accomplished by the addition of fumed silica as in Table II.

TABLE IV-continued

| Test No. | Base Oil/ Synthetic Fluid | Thickener | Solid Lubricants (2) | Avg. Load In lbs. For A "Bearing Power Requirement" Of ≧ 1 KW" |
|---|---|---|---|---|

(4) Organophillic clay/calcium acetate - In the synthetic oil the calcium acetate is formed by reacting calcium hydroxide with acetic acid and then further thickening is accomplished by the addition of organophillic clay.
(5) The synthetic hydrocarbon and polyol ester base fluids are those shown in Table II.

The grease formulations may optionally contain small amounts of conventional liquid additives such as oil soluble antioxidants, corrosion inhibitors and metal deactivators.

As can be seen from the laboratory bearing tests, those greases utilizing the synthetic fluid base/thickener systems of the invention exhibited improved performance over the calcium complex/mineral oil formulation of the prior art.

FIG. 1 shows portions of an earth boring drill bit 11 of the type intended to be used with the lubricating grease of the invention. The bit 11 includes a body 13 formed of three head sections 15 that are typically joined by a welding process. Threads 17 are formed on the top of the body 13 for connection to a conventional drill string, not shown. Each head section 15 has a cantilevered shaft or bearing pin 19 having its unsupported end oriented inward and downwardly. A generally conically shaped cutter 21 is rotatably mounted on each bearing pin 19. The cutter 21 has earth disintegrating teeth 23 on its exterior and a central opening or bearing recess 25 in its interior for mounting on the bearing pin 19. Friction bearing means formed on the bearing pin 19 and cutter bearing recess 25 are connected with lubricant passage 27. A pressure compensator 29 and associated passages constitute a lubricant reservoir that limits the pressure differential between the lubricant and the ambient fluid that surrounds the bit after flowing through the nozzle means 31.

An O-ring seal 33 can be located between the bearing pin 29 and cutter 21 at the base of the bearing pin in a seal region. The O-ring 33 and seal region 35 at the base of the bearing pin 19 prevent egress of lubricant and ingress of borehole fluid.

An annular assembly groove 37 is formed on the cylindrical surface 39 of the bearing pin 19. A registering retainer group 41 is formed in the bearing recess 25 of the cutter 21. Grooves 37 and 41 are approximately located so that they register to define an irregularly shaped annular cavity in which is located a snap-ring 43. The snap-ring 43 preferably has a circular cross-section and is formed of a resilient metal. The ring 47 contains a gap at one circumferential location, so that its annular diameter may be compressed or expanded and also so that the lubricant may flow past the ring.

Known rock bit bearing metallurgy combinations include carburized and hardened alloy steel on carburized and hardened alloy steel; copper inlaid carburized and hardened alloy steel on boronized, carburized and hardened alloy steel; elemental silver over copper inlaid carburized and hardened alloy steel on boronized carburized; and hardened alloy steel or cobalt base wear resistant bearing alloy. In a typical manufacturing method of the invention, the bearing surfaces of the pin 19 and cutter recess 25 are carburized. Carburizing techniques are known to those skilled in the art and are shown, for example in U.S. Pat. No. 4,643,051, "Pack Carburizing Process for Earth Boring Drill Bits", issued Feb. 17, 1987. After carburizing the bearing surfaces and assembling the bit, the grease of the invention is installed within the lubricant reservoir.

An invention has been provided with several advantages. The heavy-duty lubricating grease of the invention uses a novel synthetic base fluid which is combined with a thickener system to provide improved bearing performance in demanding environments such as that of the rock bit bearing. The bearing grease exhibits superior lubricating properties that can be employed in the application of lubricating both rolling element and journal type bearings in bits used to drill in abrasive atmospheres. The improved greases of the invention can be used with rock bit bearings to provide extended wear life and load carrying capacity.

While the invention has been shown in only three of its forms, it is not thus limited but is susceptible to various changes and modifications without departing from the spirit thereof.

What is claimed is:

1. A rock bit bearing grease, comprising:

a synthetic fluid base;

a thickener system for synthetic fluid base which when added to the base forms a lubricating grease and imparts not only gel structure to the grease but also extreme pressure and antiwear properties;

wherein the resulting lubricating grease is stable at downhole temperatures and pressures so as to be useful in bits drilling in hot subterranean formations; and wherein the synthetic fluid base is a hydrogenated polyalphaolefin synthetic hydrocarbon oil having a viscosity of 10 to 100 centistokes at 100 degrees C., or a mixture of such oils.

2. A rock bit bearing grease, comprising:

a synthetic fluid base;

a thickener system for synthetic fluid base which when added to the base forms a lubricating grease and imparts not only gel structure to the grease but also extreme pressure and antiwear properties;

wherein the resulting lubricating grease is stable at downhole temperatures and pressures so as to be useful in bits drilling in hot subterranean formations; and wherein the synthetic fluid base is a hydrogenated polyalphaolefin synthetic hydrocarbon oil having a viscosity of 10 to 100 centistokes at 100 degrees C., or a mixture of such oils, in combination with a polyol ester fluid.

3. A rock bit bearing grease, comprising:

a synthetic fluid base;

a thickener system for synthetic fluid base which when added to the base forms a lubricating grease and imparts not only gel structure to the grease but also extreme pressure and antiwear properties;

wherein the resulting lubricating grease is stable at downhole temperatures and pressures so as to be useful in bits drilling in hot subterranean formations;

wherein the synthetic fluid base is selected from the group consisting of synthetic hydrocarbon fluids, polyol esters, deuterated synthetic hydrocarbons, dimer acids, synthetic polyethers and synthetic fluorinated polyethers, alkylene oxide polymers and interpolymers, esters of phosphorus containing acids, silicon based oils and mixtures of the above; and wherein the thickener system is selected from the group consisting of calcium complex soap thickeners in which calcium hydroxide and acetic acid are two of the reactants forming the thickener and other metal soap thickeners and their complexes in combination with calcium acetate which is either added to or formed in the synthetic fluid base.

4. A rock bit bearing grease, comprising:

a synthetic fluid base;

a thickener system for synthetic fluid base which when added to the base forms a lubricating grease and imparts not only gel structure to the grease but also extreme pressure and antiwear properties;

wherein the resulting lubricating grease is stable at downhole temperatures and pressures so as to be useful in bits drilling in hot subterranean formations;

wherein the synthetic fluid base is selected from the group consisting of synthetic hydrocarbon fluids, Polyol esters, deuterated synthetic hydrocarbons, dimer acids, synthetic polvethers and synthetic fluorinated Polyethers, alkylene oxide polymers and interpolymers, esters of phosphorus containing acids, silicon based oils and mixtures of the above; and wherein the thickener system is a non-soap thickener system selected from the group consisting of silica gellants and clays in combination with calcium acetate which is either added to or formed in the synthetic fluid base.

5. A rock bit bearing grease, comprising:

a synthetic fluid base;

a thickener system for synthetic fluid base which when added to the base forms a lubricating grease and imparts not only gel structure to the grease but also extreme pressure and antiwear properties;

wherein the resulting lubricating grease is stable at downhole temperatures and pressures so as to be useful in bits drilling in hot subterranean formations;

wherein the synthetic fluid base is selected from the group consisting of synthetic hydrocarbon fluids, polyol esters, deuterated synthetic hydrocarbons, dimer acids, synthetic polyethers and synthetic fluorinated polyethers, alkylene oxide polymers and interpolymers, esters of phosphorus containing acids, silicon based oils and mixtures of the above; and wherein the thickener consists of silica gellant and calcium acetate where the calcium acetate is formed in the synthetic fluid base by reaction of calcium hydroxide and acetic acid.

6. A rock bit bearing grease, comprising:

a synthetic fluid base;

a thickener system for synthetic fluid base which when added to the base forms a lubricating grease and imparts not only gel structure to the grease but also extreme pressure and antiwear properties;

wherein the resulting lubricating grease is stable at downhole temperatures and pressures so as to be useful in bits drilling in hot subterranean formations;

wherein the synthetic fluid base is selected from the group consisting of synthetic hydrocarbon fluids, polyol esters, deuterated synthetic hydrocarbons, dimer acids, synthetic Polyethers and synthetic fluorinated polyethers, alkylene oxide polymers and interpolymers, esters of phosphorus containing acids, silicon based oils and mixtures of the above; and wherein the thickener system consists of modified clay and calcium acetate where the calcium acetate is formed in the synthetic fluid base by reaction of calcium hydroxide and acetic acid.

7. The rock bit bearing grease of claim 3, wherein the calcium complex soap thickener is a fatty acid complex formed by the reaction of calcium hydroxide with a plurality of organic acids one of which is acetic acid and the others of which are higher molecular weight organic acids.

8. The rock bit bearing grease of claim 3, wherein the other metal soap thickeners and their complexes are combined with calcium acetate which is either added or formed in the synthetic fluid base, wherein the metal for such other metal soap thickener is selected from the group consisting of aluminum, barium, calcium, lithium, sodium, and strontium.

9. The rock bit bearing grease of claim 3, wherein the metal complex soap thickener is a calcium complex in which the fatty acid complex is formed by the reaction of calcium hydroxide with a plurality of organic acids, one of which is acetic acid and the others of which are higher molecular weight organic acids comprised of a combination of monobasic carboxylic acids of 18, 8 and 10 carbons.

10. A rock bit bearing grease for lubricating rolling element and journal type rock bit bearings, the bearing grease comprising:

a synthetic hydrocarbon fluid as a fluid base;

a thickener system that imparts not only gel structure to the grease but also extreme pressure and antiwear properties, the thickener system being selected from the group consisting of (1) calcium complex soap thickeners in which calcium hydroxide and acetic acid are two of the reactants forming the thickener; (2) other metal soap thickeners and their complexes in combination with calcium acetate which is either added or formed in the synthetic fluid base; and (3) non-soap thickeners including silica gellants and clays in combination with calcium acetate which is either added or formed in the synthetic fluid base;

wherein the resulting lubricating grease is stable at temperatures up to at least 300 degrees F. and at accompanying downhole pressures so as to be useful in bits drilling in hot subterranean formations, has an ASTM worked penetration of no less than 265, and wherein the lowest applied load at which a bearing power requirement exceeds one kilowatt in a laboratory bearing configuration test is at least about 24 kilopounds; and wherein the synthetic hydrocarbon fluid used as the fluid base is a hydrogenated polyolefin oil having a viscosity of 10 to 100 centistokes at 100 degrees C., or mixture of such oils, which is derived from $\alpha$-aliphatic olefins selected from the group consisting of ethylene, propylene and 1-butene.

11. A rock bit bearing grease for lubricating rolling element and journal type rock bit bearings, the bearing grease comprising:

a synthetic hydrocarbon fluid as a fluid base;

a thickener system that imparts not only gel structure to the grease but also extreme pressure and antiwear properties, the thickener system being selected from the group consisting of (1) calcium complex soap thickeners in which calcium hydroxide and acetic acid are two of the reactants forming the thickener; (2) other metal soap thickeners and their complexes in combination with calcium acetate which is either added or formed in the synthetic fluid base; and (3) non-soap thickeners including silica gellants and clays in combination with calcium acetate which is either added or formed in the synthetic fluid base;

wherein the resulting lubricating grease is stable at temperatures up to at least 300 degrees F. and at accompanying downhole pressures so as to be useful in bits drilling in hot subterranean formations, has an ASTM worked penetration of no less than 265, and wherein the lowest applied load at which a bearing power requirement exceeds one kilowatt in a laboratory bearing configuration test is at least about 24 kilopounds; and wherein the synthetic hydrocarbon fluid used on the base fluid is a hydrogenated polyolefin oil having a viscosity of 10 to 100 centistokes at 100 degrees C., or a mixture of such oils, in combination with a polyol ester fluid.

12. A rock bit bearing grease for lubricating rolling element and journal type rock bit bearings, the bearing grease comprising:

a synthetic hydrocarbon fluid as a fluid base;

a thickener system that imparts not only gel structure to the grease but also extreme pressure and antiwear properties;

wherein the resulting lubricating grease is stable at temperatures up to at least 300 degrees F. and at accompanying downhole pressures so as to be useful in bits drilling in hot subterranean formations, has an ASTM worked penetration of no less than 265, and wherein the lowest applied load at which a bearing power requirement exceeds one kilowatt in a laboratory bearing configuration test is at least about 24 kilopounds; and wherein the thickener system consists of silica gellant and calcium acetate where the calcium acetate is formed in the synthetic fluid base by reaction of calcium hydroxide and acetic acid.

13. A rock bit bearing grease for lubricating rolling element and journal type rock bit bearings, the bearing grease comprising;

a synthetic hydrocarbon fluid as a fluid base;

a thickener system that imparts not only gel structure to the grease but also extreme pressure and antiwear properties;

wherein the resulting lubricating grease is stable at temperatures up to at least 300 degrees F. and at accompanying downhole pressures so as to be useful in bits drilling in hot subterranean formations, has an ASTM worked penetration of no less than 265, and wherein the lowest applied load at which a bearing power requirement exceeds one kilowatt in a laboratory bearing configuration test is at least about 24 kilopounds; and wherein the thickener system consists of modified clay and calcium acetate where the calcium acetate is formed in the synthetic fluid base by reaction of calcium hydroxide and acetic acid.

14. A rock bit bearing grease for lubricating rolling element and journal type rock bit bearings, the bearing grease comprising:

a synthetic hydrocarbon fluid as a fluid base;

a thickener system that imparts not only gel structure to the grease but also extreme pressure and antiwear properties, the thickener system being selected from the group consisting of (1) calcium complex soap thickeners in which calcium hydroxide and acetic acid are two of the reactants forming the thickener; (2) other metal soap thickeners and their complexes in combination with calcium acetate which is either added or formed in the synthetic fluid base; and (3) non-soap thickeners including silica gellants and clays in combination with calcium acetate which is either added or formed in the synthetic fluid base;

wherein the resulting lubricating grease is stable at temperatures up to at least 300 degrees F. and at accompanying downhole pressures so as to be useful in bits drilling in hot subterranean formations, has an ASTM worked penetration of no less than 265, and wherein the lowest applied load at which a bearing power requirement exceeds one kilowatt in a laboratory bearing configuration test is at least about 24 kilopounds;

wherein the rock bit bearing grease further comprises a solid lubricant package;

wherein the solid lubricant package is a combination of molybdenum disulfide and antimony trioxide.

15. A method of manufacturing an earth boring drill bit of the type having a bearing pin extending from a head section of the drill bit for rotatable mounting a cutter thereon, the bearing pin having an external region which contacts an internal region of the cutter after assembly, the method comprising the steps of:

carburizing an external region of the bearing pin;

carburizing an internal region of the cutter;

lubricating the region of contact between the external region of the bearing pin and the internal region of the cutter with a heavy-duty lubricating grease, the grease comprising:

a synthetic hydrocarbon oil as a fluid base;

a thickener system selected from the group consisting of (1) metal complex soap thickeners in which calcium hydroxide and acetic acid are two reactants forming the thickener system; (2) other metal soap thickeners and their complexes in combination with calcium acetate which is either added or formed in the synthetic fluid base; and (3) non-soap thickeners including silica gellants and clays in combination with calcium acetate which is either added or formed in the synthetic fluid base;

wherein the resulting lubricating grease is stable at temperatures up to at least 300 degrees F. and at accompanying downhole pressures so as to be useful in bits drilling in hot subterranean formations, has an ASTM worked penetration of no less than 265 and wherein the lowest applied load at which a bearing power requirement exceeds one kilowatt in a laboratory bearing configuration test is at least about 24 kilopounds; and wherein the synthetic hydrocarbon oil used as the fluid base is a hydrogenated polyolefin oil having a viscosity of 10 to 100 centistokes at 100 degrees C., which is derived from $\alpha$-aliphatic olefins selected from the group consisting of ethylene, propylene and 1-butene and mixtures thereof.

16. A method of manufacturing an earth boring drill bit of the type having a bearing pin extending from a head section of the drill bit for rotatable mounting a cutter thereon the bearing pin having an external region which contacts an internal region of the cutter after assembly, the method comprising the steps of:

carburizing an external region of the bearing pin;

carburizing an internal region of the cutter;

lubricating the region of contact between the external region of the bearing pin and the internal region of the cutter with a heavy-duty lubricating grease, the grease comprising:

a synthetic hydrocarbon oil as a fluid base;

a thickener system selected from the group consisting of (1) metal complex soap thickeners in which calcium hydroxide and acetic acid are two reactants forming the thickener system; (2) other metal soap thickeners and their complexes in combination with calcium acetate which is either added or formed in the synthetic fluid base; and (3) non-soap thickeners including silica gellants and clays in combination with calcium acetate which is either added or formed in the synthetic fluid base;

wherein the resulting lubricating grease is stable at temperatures up to at least 300 degrees F. and at accompanying downhole pressures so as to be useful in bits drilling in hot subterranean formations, has an ASTM worked penetration of no less than 265 and wherein the lowest applied load at which a bearing power requirement exceeds one kilowatt in a laboratory bearing configuration test is at least about 24 kilopounds; and wherein the synthetic hydrocarbon oil used as the fluid base is a hydrogenated polyolefin oil having a viscosity of 10 to 100 centistokes at 100 degrees C., or a mixture of such oils, in combination with a polyol ester fluid.

17. A method of manufacturing an earth boring drill bit of the type having a bearing pin extending from a head section of the drill bit for rotatably mounting a cutter thereon, the bearing pin having an external region which contacts an internal region of the cutter after assembly, the method comprising the steps of:

carburizing an external region of the bearing pin;

carburizing an internal region of the cutter;

lubricating the region of contact between the external region of the bearing pin and the internal region of the cutter with a heavy-duty lubricating grease, the grease comprising;

a synthetic hydrocarbon oil as a fluid base;

a thickener system that imparts not only gel structure to the crease but also extreme pressure and antiwear properties;

wherein the resulting lubricating grease is stable at temperatures up to at least 300 degrees F. and at accompanying downhole pressures so as to be useful in bits drilling in hot subterranean formations, has an ASTM worked penetration of no less than 265 and wherein the lowest applied load at which a bearing power requirement exceeds one kilowatt in a laboratory bearing configuration test is at least about 24 kilopounds; and wherein the thickener system consists of silica gellant and calcium acetate where the calcium acetate is formed in the synthetic fluid base by reaction of calcium hydroxide and acetic acid.

18. A method of manufacturing an earth boring drill bit of the type having a bearing pin extending from a head section of the drill bit for rotatably mounting a cutter thereon, the bearing pin having an external region which contacts an internal region of the cutter after assembly, the method comprising the steps of:

carburizing an external region of the bearing pin;

carburizing an internal region of the cutter;

lubricating the region of contact between the external region of the bearing pin and the internal region of the cutter with a heavy-duty lubricating grease, the grease comprising:

a synthetic hydrocarbon oil as a fluid base, a thickener system that imparts not only gel structure to the grease but also extreme pressure and antiwear properties;

wherein the resulting lubricating grease is stable at temperatures up to at least 300 degrees F. and at accompanying downhole pressures so as to be useful in bits drilling in hot subterranean formations, has an ASTM worked penetration of no less than 265 and wherein the lowest applied load at which a bearing power requirement exceeds one kilowatt in a laboratory bearing configuration test is at least about 24 kilopounds; and wherein the thickener system consists of modified clay and calcium acetate where the calcium acetate is formed in the synthetic fluid base by reaction of calcium hydroxide and acetic acid.

19. A method of manufacturing an earth boring drill bit of the type having a bearing pin extending from a head section of the drill bit for rotatable mounting a cutter thereon, the bearing pin having an external region which contacts an internal region of the cutter after assembly, the method comprising the steps of:

carburizing an external region of the bearing Pin;

carburizing an internal region of the cutter;

lubricating the region of contact between the external region of the bearing pin and the internal region of the cutter with a heavy-duty lubricating grease, the grease comprising:

a synthetic hydrocarbon oil as a fluid base;

a thickener system selected from the group consisting of (1) metal complex soar thickeners in which calcium hydroxide and acetic acid are two reactants forming the thickener system; (2) other metal soap thickeners and their complexes in combination with calcium acetate which is either added or formed in the synthetic fluid base; and (3) non-soap thickeners including silica gellants and clays in combination with calcium acetate which is either added or formed in the synthetic fluid base;

wherein the resulting lubricating grease is stable at temperatures up to at least 300 degrees F. and at accompanying downhole pressures so as to be useful in bits drilling in hot subterranean formations, has an ASTM worked penetration of no less than 265 and wherein the lowest applied load at which a bearing sower requirement exceeds one kilowatt in a laboratory bearing configuration test is at least about 24 kilopounds;

wherein the rock bit bearing grease contains a solid lubricant package; and wherein the solid lubricant package is a combination of molybdenum disulfide and antimony trioxide.

20. A lubricating grease for use in extreme temperature and pressure environments, the grease comprising:

a synthetic fluid base;

a thickener system that imparts not only gel structure to the grease but also extreme pressure and antiwear properties, the thickener system being selected from the group consisting of (1) calcium complex soap thickeners in which calcium hydroxide and acetic acid are two of the reactants forming the thickener; (2) other metal soap thickeners and their complexes in combination with calcium acetate which is either added or formed in the synthetic fluid base; and (3) non-soap thickeners including silica gellants and clays in combination with calcium acetate which is either added or formed in the synthetic fluid base;

wherein the resulting lubricating grease is stable at temperatures up to at least 300 degrees F.; and wherein the synthetic fluid base is a hydrogenated polyalphaolefin synthetic hydrocarbon oil having a viscosity of 10 to 100 centistokes at 100 degrees C., or a mixture of such oils.

21. A lubricating grease for use in extreme temperature and pressure environments, the grease comprising:

a synthetic fluid base;

a thickener system that imparts not only gel structure to the grease but also extreme pressure and antiwear properties, the thickener system being selected from the group consisting of (1) calcium complex soap thickeners in which calcium hydroxide and acetic acid are two of the reactants forming the thickener; (2) other metal soap thickeners and their complexes in combination with calcium acetate which is either added or formed in the synthetic fluid base; and (3) non-soap thickeners including silica gellants and clays in combination with calcium acetate which is either added or formed in the synthetic fluid base;

wherein the resulting lubricating grease is stable at temperatures up to at least 300 degrees F.; and wherein the synthetic fluid base is a hydrogenated polyalphaolefin synthetic hydrocarbon oil having a viscosity of 10 to 100 centistokes at 100 degrees C., or a mixture of such oils, in combination with a polyol ester fluid.

22. A lubricating grease for use in extreme temperature and pressure environments, the grease comprising:

a synthetic fluid base;

a thickener system that imparts not only gel structure to the grease but also extreme pressure and antiwear properties;

wherein the resulting lubricating grease is stable at temperatures up to at least 300 degrees F.; and wherein the thickener system is a non-soap thickener system selected from the group consisting of silica gellants and clays in combination with calcium acetate which is either added to or formed in the synthetic fluid base.

23. A lubricating grease for use in extreme temperature and pressure environments, the grease comprising;

a synthetic fluid base;

a thickener system that imparts not only gel structure to the grease but also extreme pressure and antiwear properties;

wherein the resulting lubricating grease is stable at temperatures up to at least 300 degrees F.; and wherein the thickener consists of silica gellant and calcium acetate where the calcium acetate is formed in the synthetic fluid base by reaction or calcium hydroxide and acetic acid.

24. A lubricating grease for use in extreme temperature and pressure environments, the grease comprising:

a synthetic fluid base;

a thickener system that imparts not only gel structure to the grease but also extreme pressure and antiwear properties;

wherein the resulting lubricating grease is stable at temperatures up to at least 300 degrees F.; and wherein the thickener system consists of modified clay and calcium acetate where the calcium acetate is formed in the synthetic fluid base by reaction of calcium hydroxide and acetic acid.

25. The lubricating grease of claim 22, wherein the other metal soap thickeners and their complexes are combined with calcium acetate which is either added or formed in the synthetic fluid base, wherein the metal for such other metal soap thickener is selected from the group consisting of aluminum, barium, calcium, lithium, sodium, and strontium.

26. The lubricating grease of claim 25, wherein the metal complex soap thickener is a calcium complex in which the fatty acid complex is formed by the reaction of calcium hydroxide with a plurality of organic acids, one of which is acetic acid and the others of which are higher molecular weight organic acids comprised of a combination of monobasic carboxylic acids of 18, 8 and 10 carbons.

* * * * *

UNITED STATES PATENT AND TRADEMARK OFFICE

CERTIFICATE OF CORRECTION

PATENT NO. : 5,891,830

DATED : April 6, 1999

INVENTOR(S) : Terry J. Koltermann and Thomas F. Willey

It is certified that error appears in the above-indentified patent and that said Letters Patent is hereby corrected as shown below:

On column 1, line 66, please delete the comma after "complex";

On column 9, footnote 9 to Table I, please delete "Tom Lin" and insert --Tomlin--;

On column 10, footnote 6 to Table II, please delete "Tom Lin" and insert --Tomlin--;

On column 13, line 40, please delete "29" and insert --19--;

On column 13, line 41, please delete "35";

On column 13, line 46, please delete "group" and insert --groove--;

On column 13, line 51, please delete "47" and insert --43--;

On column 19, line 37, please delete "crease" and insert --grease--;

On column 20, line 28, please delete "soar" and insert --soap--;

On column 20, line 43, please delete "sower" and insert --power--;

On column 22, line 12, please delete "or" and insert --of--;

UNITED STATES PATENT AND TRADEMARK OFFICE

CERTIFICATE OF CORRECTION

PATENT NO. : 5,891,830

DATED : April 6, 1999

INVENTOR(S) : Terry J. Koltermann and Thomas F. Willey

It is certified that error appears in the above-identified patent and that said Letters Patent is hereby corrected as shown below:

On column 22, line 27, please delete "22" and insert --21--;

On column 22, line 38, please delete "25" and insert --21--.

Signed and Sealed this

Twenty-ninth Day of February, 2000

*Attest:*

*Attesting Officer*

Q. TODD DICKINSON

*Commissioner of Patents and Trademarks*